US009431718B2

(12) United States Patent
Iso et al.

(10) Patent No.: US 9,431,718 B2
(45) Date of Patent: Aug. 30, 2016

(54) ANTENNA DEVICE INCLUDING TRIPLATE LINE INCLUDING CENTRAL CONDUCTOR AND GROUND PLATES

(71) Applicant: Hitachi Metals, Ltd., Tokyo (JP)

(72) Inventors: Naoki Iso, Hitachi (JP); Nobuaki Kitano, Hitachi (JP); Tomoyuki Ogawa, Hitachi (JP); Yoshiaki Ishigami, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 226 days.

(21) Appl. No.: 14/243,795

(22) Filed: Apr. 2, 2014

(65) Prior Publication Data

US 2015/0061959 A1 Mar. 5, 2015

(30) Foreign Application Priority Data

Aug. 30, 2013 (JP) ..... 2013-179481

(51) Int. Cl.
*H01Q 1/50* (2006.01)
*H01Q 21/28* (2006.01)
*H01Q 21/24* (2006.01)

(52) U.S. Cl.
CPC ..... *H01Q 21/28* (2013.01); *H01Q 21/24* (2013.01)

(58) Field of Classification Search
CPC ..... H01Q 1/50; H01Q 1/48
USPC ..... 343/848, 700 MS, 846
See application file for complete search history.

(56) References Cited

U.S. PATENT DOCUMENTS 5,801,660 A * 9/1998 Ohtsuka et al. ..... H01Q 9/0414 343/700 MS
2005/0179598 A1* 8/2005 Legay et al. ..... H01Q 21/0006 343/700 MS
2010/0085133 A1* 4/2010 Nomura et al. ..... H01P 5/107 333/248
2014/0152525 A1* 6/2014 Iso et al. ..... H01P 3/085 343/862

FOREIGN PATENT DOCUMENTS

JP 63-088902 A 4/1988

* cited by examiner

*Primary Examiner* — Hoanganh Le
(74) *Attorney, Agent, or Firm* — McGinn IP Law Group PLLC

(57) ABSTRACT

An antenna device has a feed line including a triplate line. Each triplate line has a central conductor and two ground plates sandwiching the central conductor via an air layer. At least a part of the triplate line is configured such that the two ground plates sandwich a center substrate including a wiring pattern as the central conductor provided on a dielectric substrate via the air layer.

19 Claims, 4 Drawing Sheets

ANTENNA DEVICE INCLUDING TRIPLATE LINE INCLUDING CENTRAL CONDUCTOR AND GROUND PLATES

The present application is based on Japanese patent application No. 2013-179481 filed on Aug. 30, 2013, the entire contents of which are incorporated herein by reference.

BACKGROUND OF THE INVENTION

1. Field of the Invention

This invention relates to an antenna device.

2. Description of the Related Art

As an antenna device for suppressing a loss in a feed line and simplifying an antenna structure, e.g., an antenna device using a triplate line has been developed. The triplate line includes a central conductor plate and one pair of ground plates sandwiching the central conductor plate as a feed line.

Refer to e.g JP-A 63-88902.

SUMMARY OF THE INVENTION

However, in the conventional antenna device using the triplate line as the feed line, there is a disadvantage in that, e.g., for the case of a frequency sharing antenna device, the central conductor plate cannot be made in one piece but should be divided into plural blocks, so that the number of parts or components will be increased and assembling work of the antenna device will become troublesome.

Accordingly, it is an object of the present invention to provide an antenna device which can be easily assembled.

According to a feature of the invention, an antenna device, comprises:

a feed line comprising a triplate line, each triplate line comprising a central conductor and two ground plates sandwiching the central conductor via an air layer;

wherein at least a part of the triplate line is configured such that the two ground plates sandwich a center substrate comprising a wiring pattern as the central conductor provided on a dielectric substrate via the air layer.

In the above embodiment of the invention, the following modifications and changes can be made.

(i) The dielectric substrate is located at a position where a first distance from one surface provided with the central conductor to one of the two ground plates facing to the one surface is greater than a second distance from the other surface opposed to the one surface to the other of the two ground plates facing to the other surface.

(ii) The dielectric substrate is located equidistantly from both of the two ground plates.

(iii) The triplate line comprises a first triplate line and a second triplate line connected to be intersected with the first triplate line, wherein a feed signal fed from outside is transmitted from the second triplate line to an antenna element via the first triplate line, wherein at least a part of the first triplate lines is configured such that the two ground plates sandwich the center substrate via the air layer.

(iv) The second triplate line is installed on a side of one of the two ground plates of the first triplate line and the antenna element is installed on a side of the other of the two ground plates of the first triplate line, wherein the center substrate comprises the central conductor on the dielectric substrate on a side of the antenna element.

(vi) The center substrate is supported by the two ground plates via a spacer provided at a region of the center substrate, and the region is not provided with the spacer.

Points of the Invention

According to the present invention, it is possible to provide an antenna device which can be easily assembled.

BRIEF DESCRIPTION OF THE DRAWINGS

The preferred embodiments according to the invention will be explained below referring to the drawings, wherein:

FIGS. 1A and 1B show a configuration example of an antenna device in the present embodiment, wherein FIG. 1A is a schematically cross-sectional view showing the interconnection of triplate lines in the antenna device in the present embodiment, and FIG. 1B is a schematically cross-sectional view showing a structure of a first triplate line;

FIGS. 3A and 3B show a configuration example of a second triplate line in the antenna device in FIGS. 1A and 1B, wherein FIG. 3A is a perspective view thereof in which one of ground plates is not shown, and FIG. 3B is a schematically cross-sectional view of the second triplate line;

DETAILED DESCRIPTION OF THE EMBODIMENTS

Next, an antenna device according to the present invention will be explained below with reference to appended drawings.

Figure 1A:
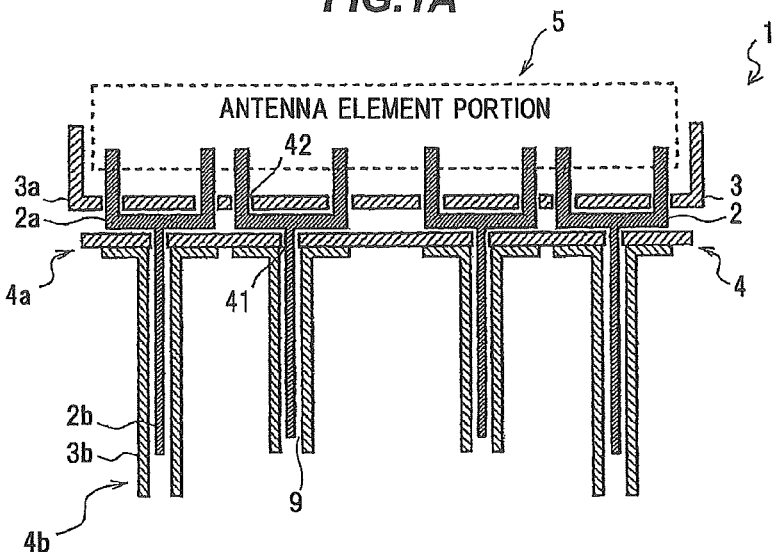
Figure 1B:
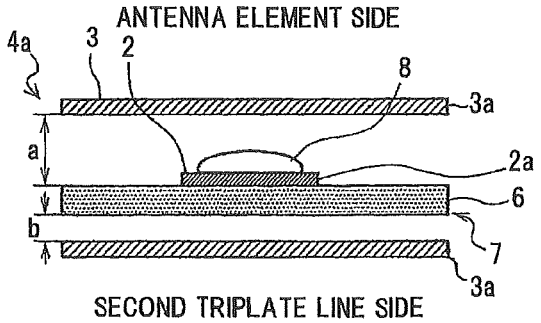

FIGS. 1A and 1B show a configuration example of an antenna device in the present embodiment, wherein FIG. 1A is a schematically cross-sectional view showing the interconnection of triplate lines in the antenna device in the present embodiment, and FIG. 1B is a schematically cross-sectional view showing a structure of a first triplate line.

Figure 2A:
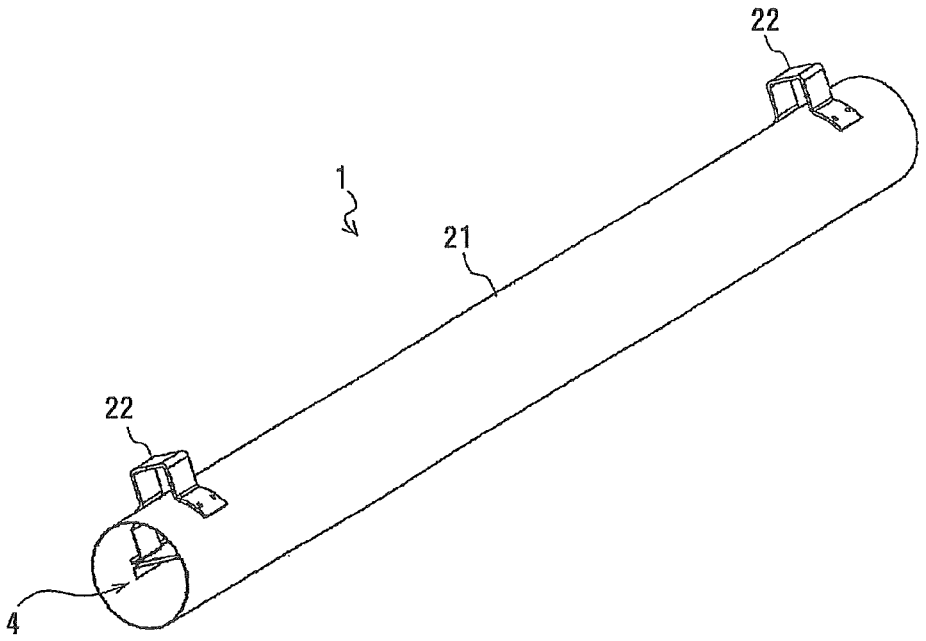
FIG. 2A is a perspective view showing an appearance of the antenna device in FIGS. 1A and 1B.
Figure 2B:
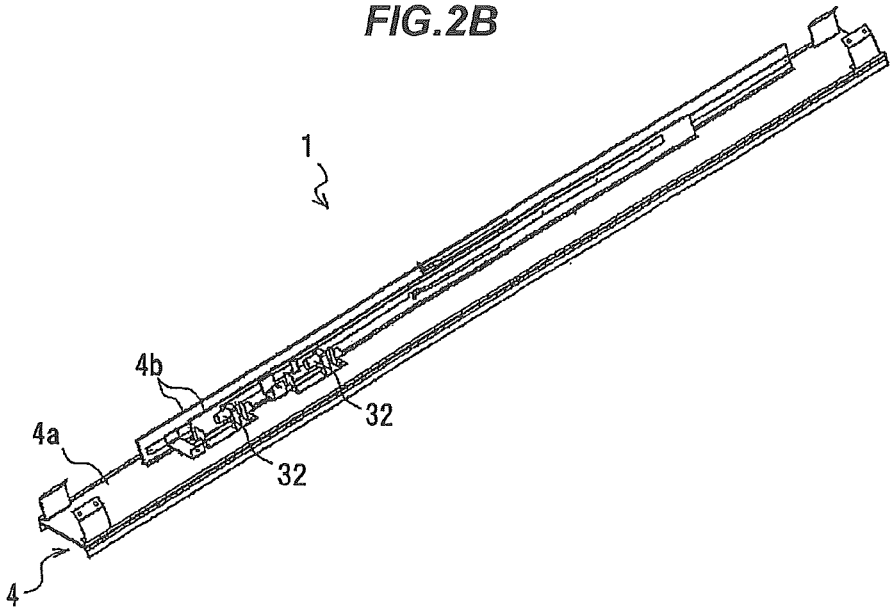
FIG. 2B is a perspective view showing an internal configuration of a radome, in which the plurality of triplate lines and the antenna elements are partially not shown.
Figure 3A:
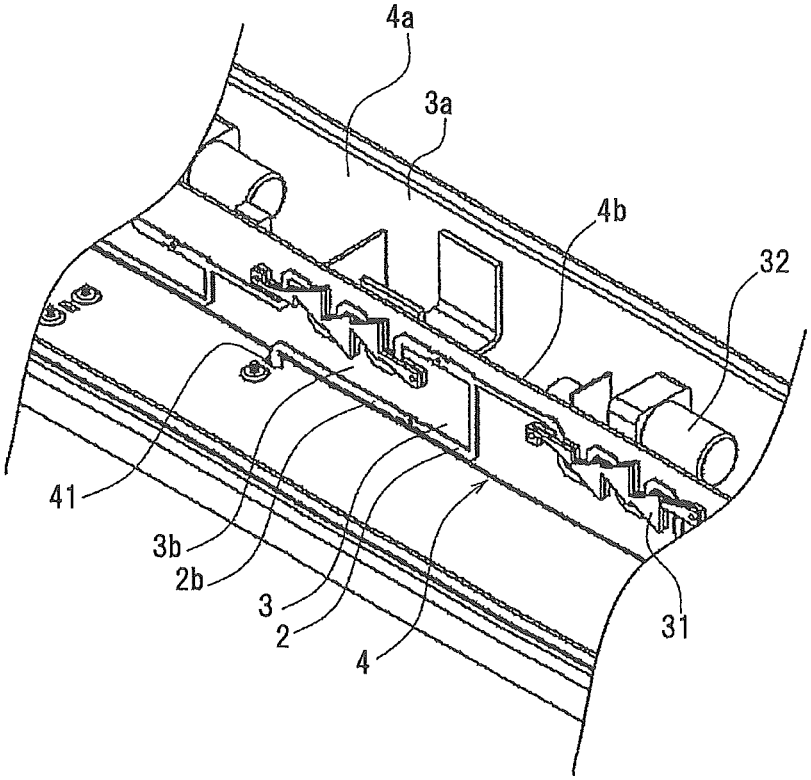
Figure 3B:
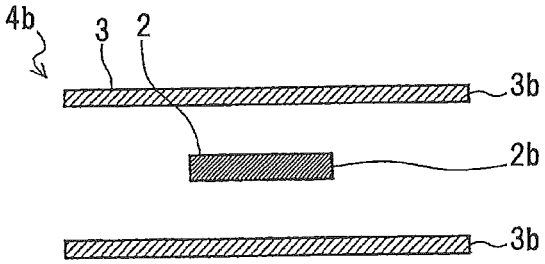

FIG. 2A is a perspective view showing an appearance of the antenna device in FIGS. 1A and 1B. FIG. 2B is a perspective view showing an internal configuration of a radome, in which the plurality of triplate lines and the antenna elements are partially not shown.

As shown in FIGS. 1A, 1B, 2A and 2B, an antenna device 1 is provided with one or more triplate line 4 as a feed line, each of which comprises a central conductor 2 and two ground plates 3 sandwiching the central conductor 2 via an air layer 9. The antenna device 1 is used as e.g. a mobile communication base station antenna.

The antenna device 1 comprises a radome 21 having a cylindrical shape. The radome 21 accommodates the triplate lines 4, and is closed by antenna caps (not shown) at both ends thereof. The radome 21 is provided with mounting brackets 22 for mounting the radome 21 on an antenna tower, etc. The antenna device 1 is mounted on the antenna tower, etc. with the mounting brackets 22 such that an axial direction (longitudinal direction) of the radome 21 is a vertical direction.

In the present embodiment, the antenna device 1, which is configured as a frequency sharing antenna for transmitting/receiving signals in two frequency bands, will be explained. When the antenna device 1 is used as the frequency sharing antenna for two frequency bands and both a vertical polarized wave and a horizontal polarized wave are used in each of the two frequency bands, four system feed lines would be required. If all the four system feed lines are incorporated in one triplate line 4, a space required for the triplate line 4 would be significantly increased and the size of an entire antenna device will be increased. Therefore, in the present embodiment, the triplate line 4 is divided into plural triplate lines and divided triplate lines are connected to be intersected with each other.

More specifically, the triplate line 4 comprises a first triplate line (lateral triplate line) 4*a*, and one or more second triplate line (vertical triplate line) 4*b* connected to be intersected with the first triplate line 4*a*. Here, one second triplate line 4*b* is provided for each of the four system feed lines. Namely, the total number of the second triplate lines 4*b* is four. These second triplate lines 4*b* (four in number) are connected to the first triplate line 4*a* such that the second triplate lines 4*b* are orthogonally intersected with the first triplate line 4*a*. In other words, the second triplate lines 4*b* are provided along a direction perpendicular to the first triplate line 4*a* and they are intersected with each other.

In the antenna device 1, a feed signal fed from outside the antenna device 1 is transmitted from the second triplate lines 4*b* to an antenna element portion 5 via the first triplate line 4*a*. In the present embodiment, the plurality of second triplate lines 4*b* (four in number) are arranged in parallel to be distant from each other. Two of the second triplate lines 4*b* for respective vertical and horizontal polarized waves in a low frequency band (e.g. 700 to 800 MHz) are located at both outer sides, while the other two of the second triplate lines 4*b* for respective vertical and horizontal polarized waves in a high frequency band (e.g. 1.5 to 2 GHz) are located at an inner side. The number of frequency bands to be shared is not limited to two. Further, the number and arrangement of the second triplate lines 4*b* are not limited to those shown in the attached drawings.

As shown in FIGS. 1A to 3B, each of the second triplate lines 4*b* comprises a central conductor plate 2*b* made of a metal plate as a central conductor 2, and two ground plates 3*b* for sandwiching the central conductor plate 2*b* via an air layer 9. The two ground plates 3*b* are opposite each other to be parallel with each other. The central conductor plate 2*b* is located in an equidistant position (i.e. equidistantly) from both of the two ground plates 3*b*, i.e., at a middle position between the two ground plates 3*b*. As the ground plate 3*b*, a plate made of aluminum which is light in weight, low in cost and excellent in weather resistance may be used.

In each of the second triplate lines 4*b*, the central conductor plate 2*b* is provided with a dielectric insertion type phase shifter 31 which is configured to distribute the feed signals input from the outside and adjust the phase of the feed signals for outputting the phase-adjusted signals to the first triplate line 4*a*. The dielectric insertion type phase shifter 31 is connected to a linear motor unit 32 for moving its dielectric plate along the central conductor plate 2*b*.

One end portion of the ground plate 3*b* of the second triplate line 4*b* is formed to have a flange shape. The flange portion is fixed to the ground plate 3*a* of the first triplate line 4*a* with bolts so that the second triplate line 4*b* is fixed to the first triplate line 4*a* as well as the ground plates 3*a*, 3*b* are electrically connected with each other.

The central conductor 2*b* of the second triplate line 4*b* includes a portion extended from the one end portion of the ground plate 3*b*, and the extended portion is inserted into a through-hole 41 formed at the ground plate 3*a* of the first triplate 4*a*, so that the central conductor plate 2*b* of the second triplate line 4*b* is electrically connected to a central conductor 2 (wiring pattern 2*a*) of the first triplate line 4*a*.

Figure 4:
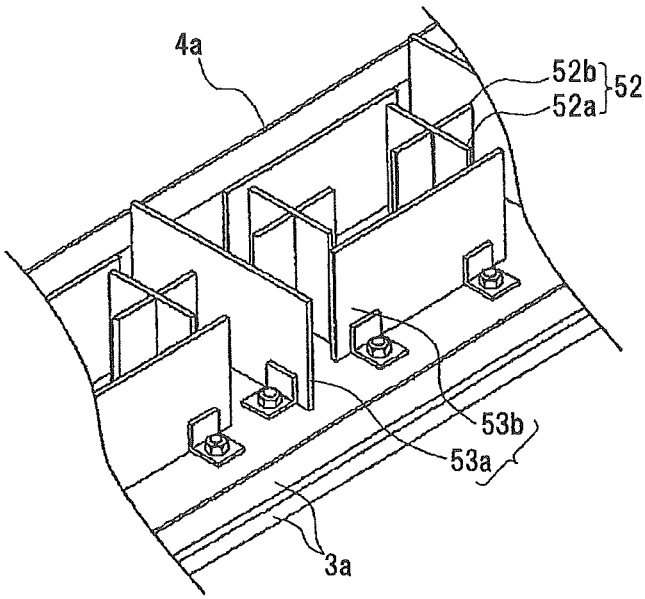
FIG. 4 is a perspective view showing a configuration of an antenna element in the antenna device in FIG. 1.

As shown in FIG. 4, an antenna element 51 is provided at the first triplate line 4*a* on the side opposite to the side provided with the second triplate lines 4*b*. Namely, in the antenna device 1, the second triplate lines 4*b* are provided at one ground plate 3*a* side of the first triplate line 4*a* and the antenna element 51 is provided at the other ground plate 3*a* side of the first triplate line 4*a*.

The antenna element 51 comprises a wiring pattern formed on a plate-like substrate comprising an electrically insulating material such as resin, and the antenna element 51 is installed in a standing manner on the one ground plate 3*a* of the first triplate line 4*a*.

The antenna element 51 has two antenna element pairs 52, 53 corresponding to the two frequency bands. A first antenna element pair 52 for a high frequency band has a first horizontal polarized antenna element 52*a*, and a first vertical polarized antenna element 52*b*. A second antenna element pair 53 for a low frequency band has a second horizontal polarized antenna element 53*a*, and a second vertical polarized antenna element 53*b*. It should be noted that the configuration and arrangement of the antenna element 51 are not limited to those shown in FIGS. 1A to 3B. The antenna element 51 is electrically connected with the central conductor 2 (wiring pattern 2*a*) of the first triplate line 4*a* through a through-hole 42 formed at the ground plate 3*a* of the first triplate line 4*a* (cf. FIG. 1A).

Figure 5:
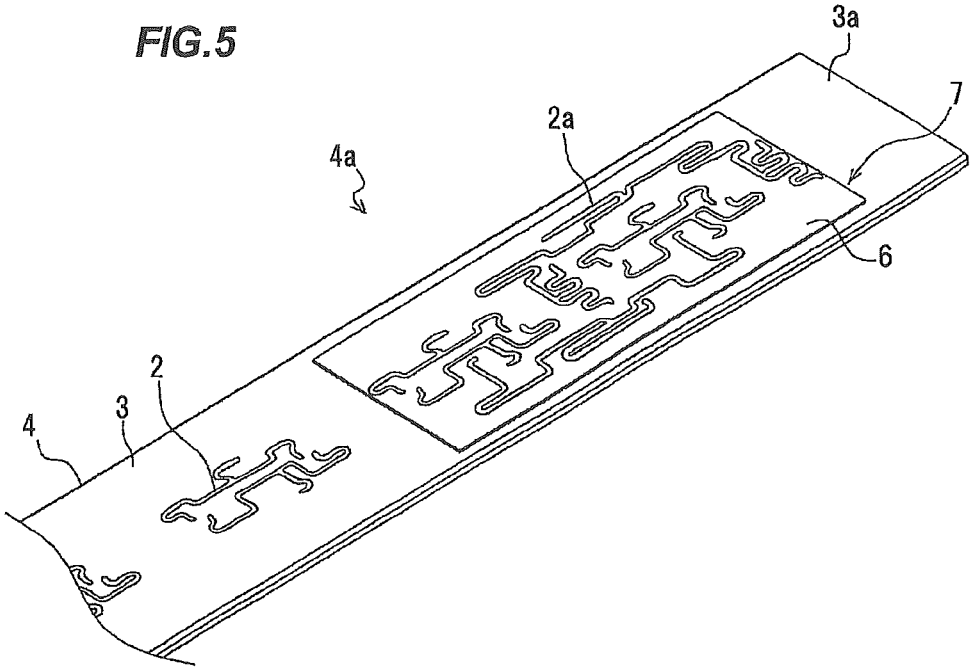
FIG. 5 is a perspective view of the first triplate line in the antenna device in FIG. 1 in which one of ground plates is not shown.

Referring to FIGS. 1B and 5, in the antenna device 1 according to the present embodiment, at least a part of the triplate lines 4 is configured such that the two ground plates 3 sandwich a center substrate 7 comprising the wiring pattern 2*a* as the central conductor 2 provided on a dielectric substrate 6 via an air layer 9, In the present embodiment, at least a part of the first triplate line 4*a* is configured such that the two ground plates 3*a* sandwich the center substrate 7 via the air layer 9. The dielectric substrate 6 may be e.g. FR4 (Flame Retardant Type 4) substrate. As the ground plate 3*a*, a plate made of aluminum which is light in weight, low in cost and excellent in weather resistance may be used.

Since the wiring pattern 2*a* provided on the center substrate 7 is used as the central conductor 2 of each of the triplate lines 4, even though the central conductor 2 is divided into a plurality of blocks, these parts or components can be handled as an integral part and the assembling thereof will be carried out easily.

In the antenna device 1 according to the present embodiment, the feed signals distributed by the second triplate lines 4*b* are further distributed to the respective antenna elements 51 through the first triplate line 4*a*. Therefore, the central conductor 2 of the first triplate line 4*a* is necessarily divided into plural (a lot of) blocks as shown in FIG. 5. Thus, the assembling of the antenna device 1 can be facilitated remarkably by providing the first triplate line 4*a* including the central conductor 2 to be divided into plural blocks with a triplate structure using the center substrate 7 (hereinafter referred to as "substrate triplate structure").

It should be noted that, in the present embodiment, only the first triplate line 4*a* is explained as the substrate triplate structure, however, the present invention is not limited thereto. The second triplate line 4*b* may have the substrate triplate structure. It should be noted that when the substrate triplate structure is applied to the second triplate lines 4*b*, the assembling of the antenna device 1 will be facilitated but the dielectric loss may be increased, because the second triplate line 4*b* includes the central conductor 2 having a relatively long line length for distributing the feed signal.

Thus, it is preferable to apply the substrate triplate structure to only a portion in which a line length of the central conductor 2 is short and divided into plural portions, like the first triplate line 4*a* in the present embodiment, in order to suppress the dielectric loss at a low level.

As shown in FIG. 1B, the dielectric substrate 6 is located at the position where a distance "a" from one surface provided with the wiring pattern 2*a* as the central conductor 2 to the ground plate 3*a* facing to the one surface is greater than a distance "b" from the other surface opposed to the one surface to the ground plate 3*a* facing to the other surface.

It is necessary to locate the wiring pattern 2*a* as the central conductor 2 and the ground plate 3*a* to be close to each other to some extent, so as to secure isolation between the lines. At this time, the central conductor plate 2*b* of each of the second triplate lines 4*b* is soldered to the wiring pattern 2*a*. Therefore, when the wiring pattern 2*a* is too close to the ground plate 3*b*, a solder 8 for soldering the central conductor plate 2*b* may contact with the ground plate 3*a*. Thus, in the present embodiment, the dielectric substrate 6 is placed at a position closer to the other side opposite to the side formed with the wiring pattern 2*a* than a middle position between the two ground plates 3*a*, 3*a*, such that the isolation will be secured while the contact of the solder 8 to the ground plates 3*a* can be suppressed. Herein, the dielectric substrate 6 is located such that the two ground plates 3*a* are arranged equidistantly from the wiring pattern 2*a*.

Also, in the present embodiment, the center substrate 7 is configured such that the wiring pattern 2*a* is formed on an antenna element 51 side surface of the dielectric substrate 6. If the wiring pattern 2*a* is formed on a second triplate line 4*b* side surface, such a configuration may reduce a work space for soldering the wiring pattern 2*a* and the central conductor plate 2*b* after fixing the second triplate lines 4*b*, thereby the work of the soldering may become difficult.

The center substrate 7 is supported by the ground plate 3*a* via a spacer (not shown). The spacer is preferably provided at a region with no wiring pattern 2*a* of the center substrate 7. If the spacers are provided at a region with the wiring pattern 2*a*, the impedance will be varied so that it will be necessary to perform adjustment, e.g., to lengthen the line length. Namely, it is necessary to provide the spacer directly on the central conductor plate 2*b* in the triplate line 4 using the metal plate (central conductor plate 2*b*) for the central conductor 2, so that it will be necessary to perform adjustment, e.g., to lengthen the line length for impedance matching. Meanwhile, according to the substrate triplate structure, such an adjustment will become needless as well as the line length will be shortened and the center substrate 7 will be downsized. As a result, the installation work of the center substrate 7 will be carried out easily.

As described above, in the antenna device 1 according to the present embodiment, at least a part of the triplate line 4 is configured such that the two ground plates 3 sandwich the center substrate 7 comprising the wiring pattern 2*a* as the central conductor 2 provided on the dielectric substrate 6 via the air layer 9.

When a metal plate (central conductor plate) is used for the central conductor 2, the central conductor 2 is divided for respective frequencies and further for respective polarized waves in order to provide the frequency sharing, which would make the assembling work troublesome. According to the present embodiment, the center substrate 7 comprising the wiring pattern 2*a* as the central conductor 2 provided on the dielectric substrate 6 is used, so that the central conductors 2 for respective frequencies and for respective polarized waves can be integrated and the assembling work can be facilitated.

Also, according to the substrate triplate structure, it is not necessary to provide the spacer directly on the central conductor 2. Further, the wavelength shortening effect can be achieved by the presence of the dielectric substrate 6. In comparison with the case that the metal plate (central conductor plate) is used for the central conductor 2, the line length of the central conductor 2 can be shortened and the center substrate 7 will be downsized. As a result, the installation work of the center substrate 7 will be carried out more easily.

The present invention is not limited to the above embodiment, and modification or variation may be made without going beyond the scope of the present invention.

For example, the shape of the ground plate 3 or the central conductor 2 (including the center substrate 7) is not limited to a planar shape or plate-like shape and may be a curved shape.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna device, comprising:

a feed line comprising a triplate line, the triplate line comprising a central conductor and two ground plates sandwiching the central conductor via an air layer;

wherein at least a part of the triplate line is configured such that the two ground plates sandwich a center substrate comprising a wiring pattern as the central conductor provided on a dielectric substrate via the air layer, wherein the triplate line comprises a first triplate line and a second triplate line connected to be intersected with the first triplate line, wherein a feed signal fed from outside is transmitted from the second triplate line to an antenna element via the first triplate line, wherein at least a part of the first triplate line is configured such that the two ground plates sandwich the center substrate on the dielectric substrate via the air layer, and wherein the second triplate line comprises two ground plates and a central conductor plate comprising a metal plate.

2. The antenna device according to claim 1, wherein the dielectric substrate is located at a position where a first distance from one surface provided with the central conductor to one of the two ground plates facing to the one surface is greater than a second distance from the other surface opposed to the one surface to an other of the two ground plates facing to the other surface.

3. The antenna device according to claim 2, wherein the dielectric substrate is located equidistantly from both of the two ground plates.

4. The antenna device according to claim 1, wherein the second triplate line is installed on a side of one of the two ground plates of the first triplate line and the antenna element is installed on a side of an other of the two ground plates of the first triplate line, and wherein the center substrate comprises the central conductor on the dielectric substrate on a side of the antenna element.

5. The antenna device according to claim 1, wherein the center substrate is supported by the two ground plates at a region of the center substrate.

6. The antenna device according to claim 1, wherein includes a radome having a cylindrical shape.

7. The antenna device according to claim 1, wherein the antenna device is configured as a frequency sharing antenna for transmitting and receiving signals in two frequency bands.

8. The antenna device according to claim 7, wherein each of the two frequency bands applies a vertical polarized wave and a horizontal polarized wave.

9. The antenna device according to claim 1, wherein the second triplate line is orthogonally intersected with the first triplate line.

10. The antenna device according to claim 1, wherein the second triplate line longitudinally extends perpendicular to a longitudinal direction of an extension of the first triplate line.

11. The antenna device according to claim 1, wherein the central conductor plate of the second triplate line is located in an equidistant position from the two ground plates of the second triplate line.

12. The antenna device according to claim 1, wherein the central conductor plate of the second triplate line is provided with a dielectric insertion-type phase shifter.

13. The antenna device according to claim 1, wherein an end portion of one of the ground plates of the second triplate line includes a flange portion fixed to one of the two ground plates of the first triplate line.

14. The antenna device according to claim 13, wherein the central conductor of the second triplate line includes an extended portion extending from the end portion of the one of the ground plates of the second triplate line.

15. The antenna device according to claim 14, wherein the extended portion is inserted into a through-hole located at one of the two ground plates of the first triplate such that the central conductor plate of the second triplate line is electrically connected to the wiring pattern of the first triplate line.

16. The antenna device according to claim 1, wherein the second triplate line is provided at one ground plate side of the first triplate line, and the antenna element is provided at an other ground plate side of the first triplate line.

17. The antenna device according to claim 1, wherein the wiring pattern is located on an antenna element side surface of the dielectric substrate.

18. The antenna device according to claim 1, wherein the center substrate is supported by the two ground plates at a region of the center substrate located outside the wiring pattern.

19. The antenna device according to claim 1, wherein the central conductor plate of the second triplate line is electrically connected to the wiring pattern of the first triplate line.

* * * * *